US007213657B2

(12) United States Patent
Vold et al.

(10) Patent No.: US 7,213,657 B2
(45) Date of Patent: May 8, 2007

(54) APPARATUS AND METHODS FOR INSTALLING INSTRUMENTATION LINE IN A WELLBORE

(75) Inventors: Gisle Vold, Sandnes (NO); Mike Foster, Katy, TX (US); Jesse Constantine, Kingwood, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 311 days.

(21) Appl. No.: 10/812,273

(22) Filed: Mar. 29, 2004

(65) Prior Publication Data

US 2005/0211441 A1 Sep. 29, 2005

(51) Int. Cl.
*E21B 41/00* (2006.01)
*E21B 23/14* (2006.01)

(52) U.S. Cl. ..... 166/385; 166/162; 166/242.5

(58) Field of Classification Search ..... 166/382, 166/380, 385, 162, 242.5, 242.6
See application file for complete search history.

(56) References Cited

U.S. PATENT DOCUMENTS

| | | | | |
|---|---|---|---|---|
| 4,367,797 | A * | 1/1983 | Brown | 166/380 |
| 4,524,834 | A * | 6/1985 | Barron et al. | 166/385 |
| 4,781,607 | A * | 11/1988 | Rumbaugh | 439/191 |
| 5,831,156 | A * | 11/1998 | Mullins | 73/152.18 |
| 6,227,302 | B1 * | 5/2001 | Pringle et al. | 166/374 |
| 6,230,812 | B1 * | 5/2001 | Reaux | 166/378 |
| 6,241,022 | B1 * | 6/2001 | Mailand et al. | 166/380 |
| 6,446,728 | B2 * | 9/2002 | Chau et al. | 166/380 |
| 6,561,278 | B2 * | 5/2003 | Restarick et al. | 166/378 |
| 6,568,481 | B2 * | 5/2003 | Koehler et al. | 166/385 |
| 2002/0162666 | A1 * | 11/2002 | Koehler et al. | 166/385 |
| 2003/0085815 | A1 * | 5/2003 | Tilton et al. | 340/854.4 |
| 2003/0221829 | A1 * | 12/2003 | Patel et al. | 166/278 |
| 2005/0072564 | A1 * | 4/2005 | Grigsby et al. | 166/65.1 |
| 2005/0109515 | A1 * | 5/2005 | Watson et al. | 166/369 |

FOREIGN PATENT DOCUMENTS

| | | |
|---|---|---|
| GB | 2392461 | 3/2004 |
| WO | WO 02/06625 | 1/2002 |
| WO | WO 04/044379 | 5/2004 |

OTHER PUBLICATIONS

U.K. Search Report, Application No. GB0506289.8, dated May 9, 2005.

* cited by examiner

*Primary Examiner*—Jennifer H Gay
(74) *Attorney, Agent, or Firm*—Patterson & Sheridan, LLP

(57) ABSTRACT

A coupler and a method for installing an instrumentation line, such as fiber optic cable, into a wellbore. The coupler places upper and lower instrumentation lines in communication with one another downhole to form a single line. The coupler comprises a landing tool and a stinger that lands on the landing tool, thereby placing the upper and the lower instrumentation lines in communication. The landing tool is run into the wellbore at the lower end of a tubular, such as production tubing. The upper instrumentation line affixes to the tubing and landing tool and extends to the surface. The lower instrumentation line affixes along the stinger. In this manner, the lower instrumentation line may be installed after expansion of a well screen or liner and may be later removed from the wellbore prior to well workover procedures without pulling the production string.

29 Claims, 9 Drawing Sheets

APPARATUS AND METHODS FOR INSTALLING INSTRUMENTATION LINE IN A WELLBORE

BACKGROUND OF THE INVENTION

1. Field of the Invention

The invention generally relates to methods and apparatus for connecting instrumentation lines in a wellbore. More particularly, the invention provides methods and apparatus for delivering a fiber optic cable to a selected depth within a hydrocarbon wellbore.

2. Description of the Related Art

In a typical oil or gas well, a borehole drilled into the surface of the earth extends downward into a formation to provide a wellbore. The wellbore may include any number of tubular strings such as a string of surface casing cemented into place and a liner string hung off of the casing that extends into a producing zone, or pay zone, where the liner is perforated to permit inflow of hydrocarbons into the bore of the liner. Alternatively, the wellbore may be completed as an open hole which may include a sand screen positioned at the end of the casing to support the formation and filter hydrocarbons that pass therethrough. During the life of the well, it is sometimes desirable to monitor conditions in situ. Recently, technology has enabled well operators to monitor conditions within a wellbore by installing permanent monitoring systems downhole. The monitoring systems permit the operator to monitor such parameters as multiphase fluid flow, as well as pressure and temperature. Downhole measurements of pressure, temperature and fluid flow play an important role in managing oil and gas or other sub-surface reservoirs.

Historically, permanent monitoring systems have used electronic components to provide pressure, temperature, flow rate and water fraction data on a real-time basis. These monitoring systems employ temperature gauges, pressure gauges, acoustic sensors, and other instruments, or "sondes," disposed within the wellbore. Such electrical instruments are either battery operated, or are powered by electrical cables deployed from the surface. Typically, conductive electrical cables transmit the electrical signals from the electronic sensors back to the surface.

Recently, optical sensors have been developed which communicate readings from the wellbore to optical signal processing equipment located at the surface. The optical sensors may be variably located within the wellbore and do not require an electrical line from the surface. For example, optical sensors may be positioned in fluid communication with the housing of a submersible electrical pump. Such an arrangement is taught in U.S. Pat. No. 5,892,860, issued to Maron, et al., in 1999. The '860 patent is incorporated herein in its entirety, by reference. Optical sensors may also be disposed along the tubing within a wellbore to sense the desired parameters. As another example of an optical sensor, a distributed temperature sensor system is a known measurement technique that provides a continuous temperature profile along the entire length of an optical fiber. Distributed temperature sensor systems operate on the principle of backscattering, the known velocity of light and the thermal energy in the optical fiber. Regardless of the type of optical sensor, an optical waveguide or fiber optic cable runs from the surface to the optical sensor downhole. Surface equipment transmits optical signals to the downhole optical sensors via the fiber optic cables which transmit return optical signals to an optical signal processor at the surface.

Therefore, both optical and electronic sensors often require an instrumentation line such as a fiber optic cable, a wire or a conductive electric cable that runs down the wellbore to the sensor. The instrumentation line may run down the outer surface of one of the tubular strings in the wellbore such as production tubing and clamp thereto at intervals as is known in the art. When the instrumentation line is on the outside of a liner or sand screen, the instrumentation line may be subjected to trauma or damage as the liner or sand screen runs into the wellbore. Trauma further increases where the instrumentation line is disposed along the outer surface of an expanded liner or sand screen since the instrumentation line compresses between the outer surface of the liner or sand screen and the surrounding formation.

Further, the instrumentation line may be exposed to the harsh effects of chemicals used in well completion or remediation operations. For example, it is oftentimes desirable to wash the tubing in order to remove grease and contaminants during a last stage in well completion. This is accomplished by circulating acid through the tubing. In addition, an acid wash or other stimulant may clean the sand screen and tubing of paraffins, hydrates and scale that accumulate along the sand screen and tubing during the life of a producing well. The application of such chemicals may be detrimental to the integrity of the instrumentation line. This is particularly true where the instrumentation line is a fiber optic cable of a distributed temperature sensor system. A packer may isolate an upper section of the instrumentation line from the chemicals used in the well completion or remediation operations such that only a lower section of the instrumentation line is subject to the harsh chemicals.

The expandable sand screen may include protective features that help protect the instrumentation line disposed along the outside of the sand screen as the sand screen is run and expanded. For example, the instrumentation line may pass along a recess in the outer diameter of the sand screen. Arrangements for the recess are described more fully in the application entitled "Profiled Recess for Instrumented Expandable Components," having Ser. No. 09/964,034, now U.S. Pat. No. 6,877,553 issued Apr. 12. 2005. which is incorporated herein in its entirety, by reference. Alternatively, a specially profiled encapsulation around the sand screen which contains arcuate walls may house the instrumentation line. Arrangements for the encapsulation are described more fully in the application entitled "Profiled Encapsulation for Use with Expandable Sand Screen," having Ser. No. 09/964,160, now U.S. Pat. No. 6,932,161 issued Aug. 23, 2005, which is also incorporated herein in its entirety, by reference. However, these protective features fail to protect the instrumentation line from the chemicals used during well completion and remediation operations. With the instrumentation line clamped to a liner or sand screen and/or disposed in a protective feature of a sand screen, it is not possible to pull the instrumentation line during an acid wash or other remedial operation, at least not without pulling the tubular and/or sand screen.

Therefore, there exists a need for a method of installing an instrumentation line into a wellbore after expansion of a sand screen or other liner, after setting of a packer, and/or after conducting an acid wash. Further, a need exists for a coupling apparatus that permits a lower instrumentation line to connect downhole with an upper instrumentation line after the upper instrumentation line is placed in the wellbore. There exists a further need for a coupling apparatus that allows the lower instrumentation line to be detached and removed from the wellbore without removing the upper instrumentation line.

SUMMARY OF THE INVENTION

The invention provides a coupler and a method for installing an instrumentation line, such as fiber optic cable, into a wellbore. The coupler places upper and lower instrumentation lines in communication with one another downhole to form a single line. The apparatus comprises a landing tool and a stinger that lands on the landing tool, thereby placing the upper and the lower instrumentation lines in communication. The landing tool is run into the wellbore at the lower end of a tubular, such as production tubing. The upper instrumentation line affixes to the tubing and landing tool and extends to the surface. The lower instrumentation line affixes along the stinger. In this manner, the lower instrumentation line may be installed after expansion of a well screen or liner and may be later removed from the wellbore prior to well workover procedures without pulling the production string.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
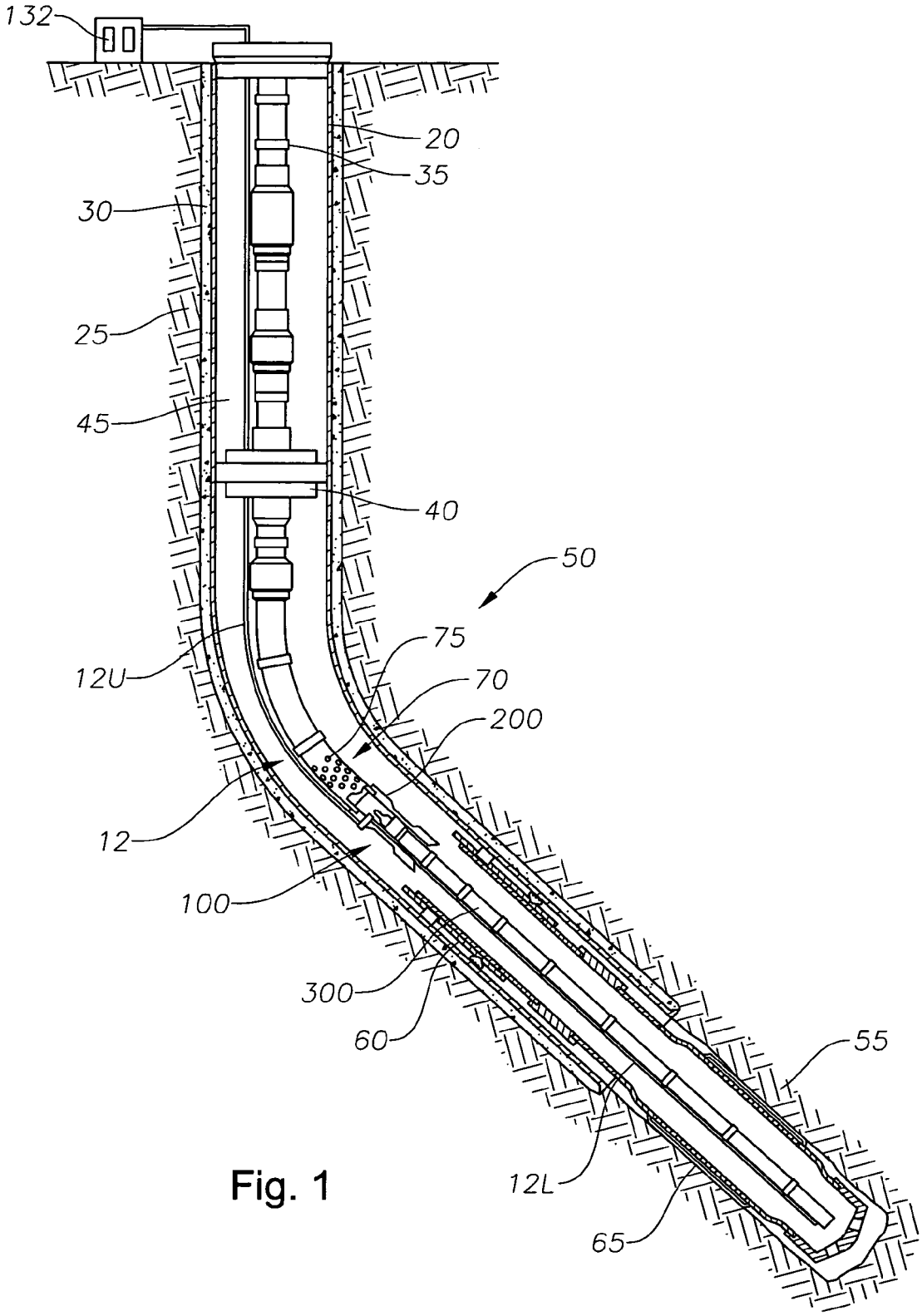
FIG. 1 is a partial sectional view of a wellbore having a coupler that includes a landing tool at the end of a tubular string and a stinger landed in the landing tool.

FIG. 1 illustrates a partial sectional view of an exemplary wellbore 50 that may receive a coupler 100 of the invention. While the coupler 100 is shown generally in FIG. 1, the detail of the coupler 100 will be described in detail with reference to the various figures hereinafter. The wellbore 50 includes a string of casing 20 secured within a surrounding earth formation 25 by cement 30, a tubular string such as production tubing 35 run into the casing 20, an instrumentation line 12 and a packer 40 that seals the annular region 45 between the tubing 35 and the surrounding casing 20. The wellbore 50 is completed with a screen hanger 60 that supports a sand screen 65 adjacent a desired pay zone 55. As shown, the coupler 100 connects to the tubing 35 by a flow sub 70. The flow sub 70 includes perforations 75 that permit the inflow of hydrocarbons for production and the circulation of chemicals around the coupler 100 during later well completion or remediation operations.

The instrumentation line 12 includes an upper instrumentation line 12U and a lower instrumentation line 12L. The instrumentation lines 12U, 12L may be an electrical line, an optical waveguide or a cable comprised of both optical fibers and electrical wires. Where the instrumentation lines 12U, 12L are fiber optic lines, the lines 12U, 12L may be part of a distributed temperature sensor system, a pressure and temperature sensor system, a flow meter, an acoustic sensor system, a chemical sensor, a seismic sensor or any other type of sensor or system including combinations thereof. In any case, the lower instrumentation line 12L is recoverably delivered to the depth of the pay zone 55 such that the line 12L extends to a level within the wellbore 50 below the packer 40 and adjacent the sand screen 65. The upper instrumentation line 12U runs along the tubing 35 to the surface and is connected to surface instrumentation 132.

The invention is directed to the coupler 100 and a method for using the coupler 100. The coupler 100 places the upper 12U and lower 12L instrumentation lines in communication with one another, thereby forming the single instrumentation line 12. However, the operator may remove the lower instrumentation line 12L from the wellbore 50 at any time after the coupler 100 has placed the upper and lower instrumentation lines 12U, 12L in communication. In this manner, the lower portion 12L of the instrumentation line 12 is spared trauma from later remediation or well workover procedures. Therefore, the wellbore completion arrangement shown in FIG. 1 is for exemplary purposes only. The invention is not limited as to the manner of completing the well, and the coupler 100 may be employed in any open hole completion, cased hole completion, injection well, lateral well, horizontal well or other known or contemplated wells as can be appreciated by one skilled in the art.

The coupler 100 comprises a landing tool 200 and a stinger 300 that are connected to one another downhole. In operation, the landing tool 200 is disposed at the lower end of the tubing 35, and the upper instrumentation line 12U connects to the landing tool 200 and runs into the wellbore 50 with the tubing 35 and landing tool 200. The lower instrumentation line 12L connects to the stinger 300. The stinger 300 releasably couples to a working string such as coiled tubing string (not shown) and runs into the wellbore 50 on the working string after the tubing 35 and landing tool 200 are in place. In this manner, the stinger 300 lands on the landing tool 200 as shown in FIG. 1 to bring the upper and lower instrumentation lines 12U, 12L together and provide the instrumentation line 12 as will be explained more fully hereinafter. Thereafter, the working string releases from the stinger 300 and the working string is removed from the wellbore 50. As shown, the length of the stinger 300 that extends from the landing tool 200 may be selected such that lower instrumentation line 12L that is attached to the stinger 300 is positioned at the desired depth within the wellbore 50.

Figure 2:
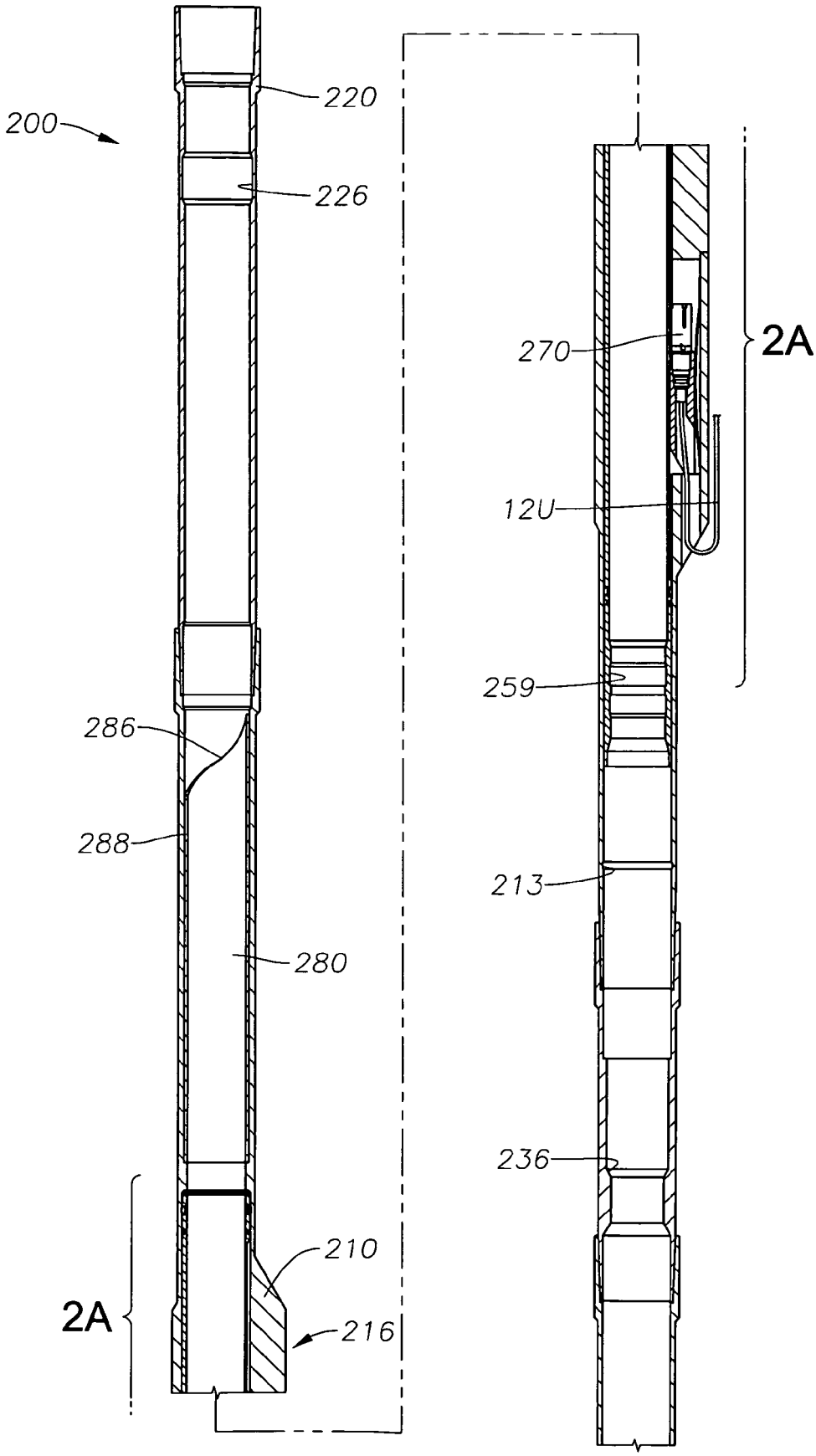
FIG. 2 is a partial sectional view of the landing tool in a run-in position.
Figure 8:
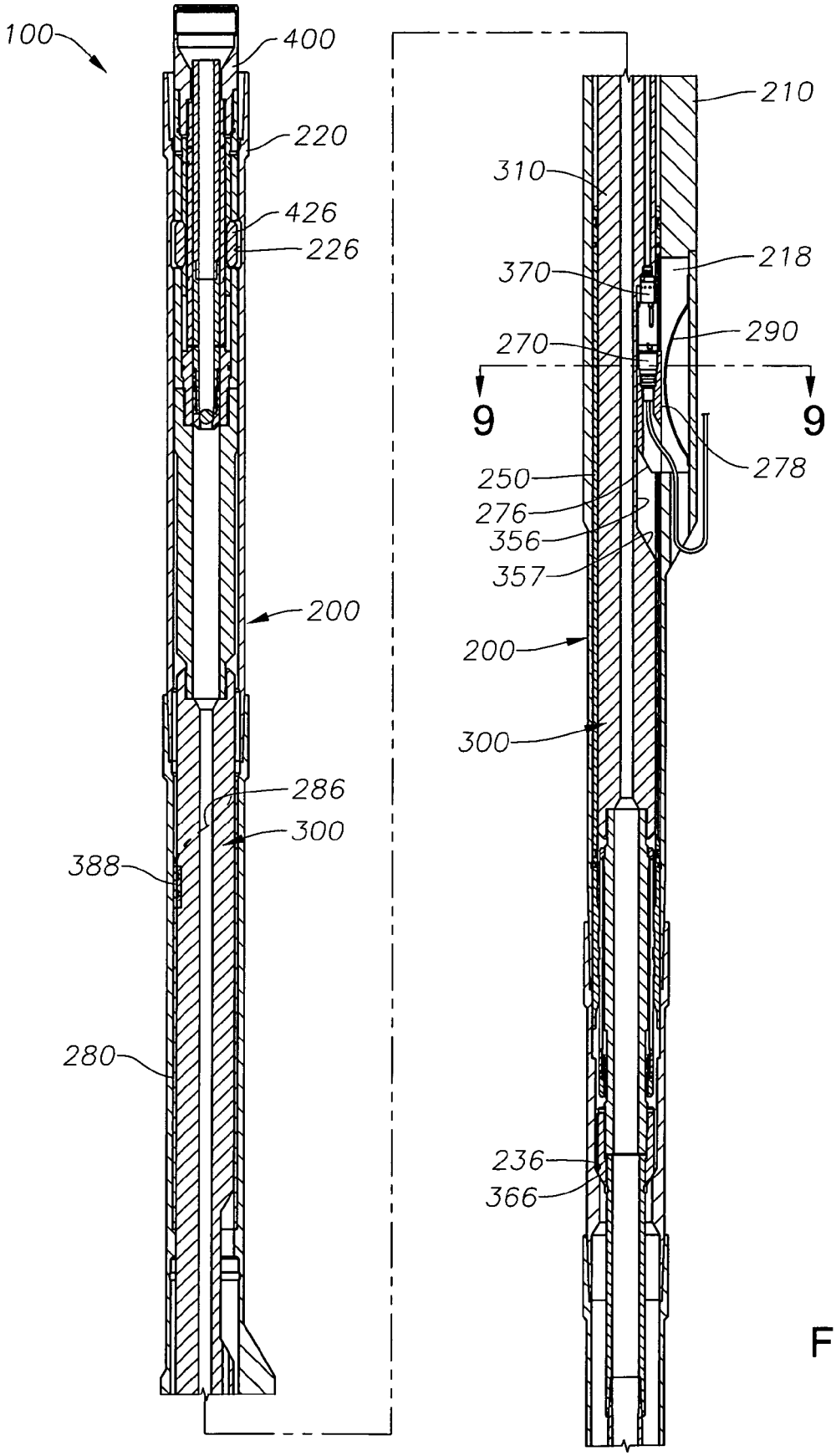
FIG. 8 is a partial sectional view of the coupler in a connected position with the stinger landed within the landing tool.

FIG. 2 shows a partial section view of a portion of the landing tool 200 of the coupler 100 in a run-in position. The landing tool 200 includes a series of tubular subs connected by threads or otherwise in order to form an elongated tubular body. As shown in FIG. 8 with the landing tool 200 and stinger 300 of the coupler 100 in the connected position, the landing tool 200 receives a portion of the stinger 300 within the bore of the elongated tubular body. A landing profile 236 located on the inner diameter of the landing tool 200 mates with a corresponding landing shoulder 366 of the stinger 300 to limit movement of the stinger 300 through the landing tool 200. One of the tubular subs of the landing tool 200 is an offset mandrel 210 having an enlarged outer diameter portion 216. The landing tool 200 may include additional tubular subs or a combination of one or more of the subs shown integrated into a single sub depending upon the manufacturing protocol. In the arrangement shown in FIG. 2, the landing tool 200 includes several subs in addition to the offset mandrel 210. For example, the landing tool 200 may include an upper locking sub 220 having a profile 226 along its inner diameter for receiving locking dogs 426 of an optional latching mechanism 400 of the stinger 300 as shown in FIG. 8.

Figure 4:
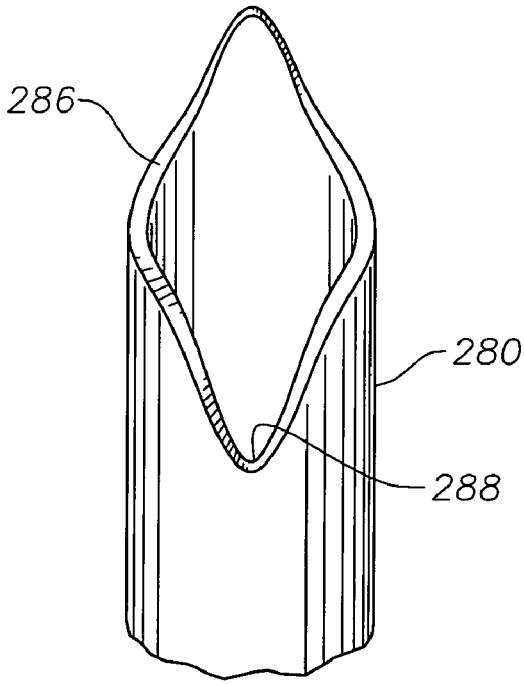
FIG. 4 is a perspective view of an upper portion of an orienting sleeve of the landing tool.

An orienting sleeve 280 shown disposed within the offset mandrel 210 of the landing tool 200 is rotationally fixed within the offset mandrel 210. Preferably, the orienting sleeve 280 threads into the inner diameter of the offset mandrel 210. In the arrangement shown in FIG. 2, the lower end of the orienting sleeve 280 threads down onto a shoulder along the inner diameter of the offset mandrel 210. However, a weld or other connection may be provided. The orienting sleeve 280 provides proper rotational orientation for the stinger 300 as the stinger 300 lands into the landing tool 200. To this end, the upper end of the orienting sleeve 280 includes an orienting shoulder 286 that receives a key 388 of the stinger 300 when in the connected position shown in FIG. 8. In one arrangement, the orienting shoulder 286 is helical. FIG. 4 provides a prospective view of the top portion of the orienting sleeve 280 with the helical orienting shoulder 286. The orienting shoulder 286 includes a bottom-out edge 288 into which the key 388 of the stinger 300 is guided.

Figure 2A:
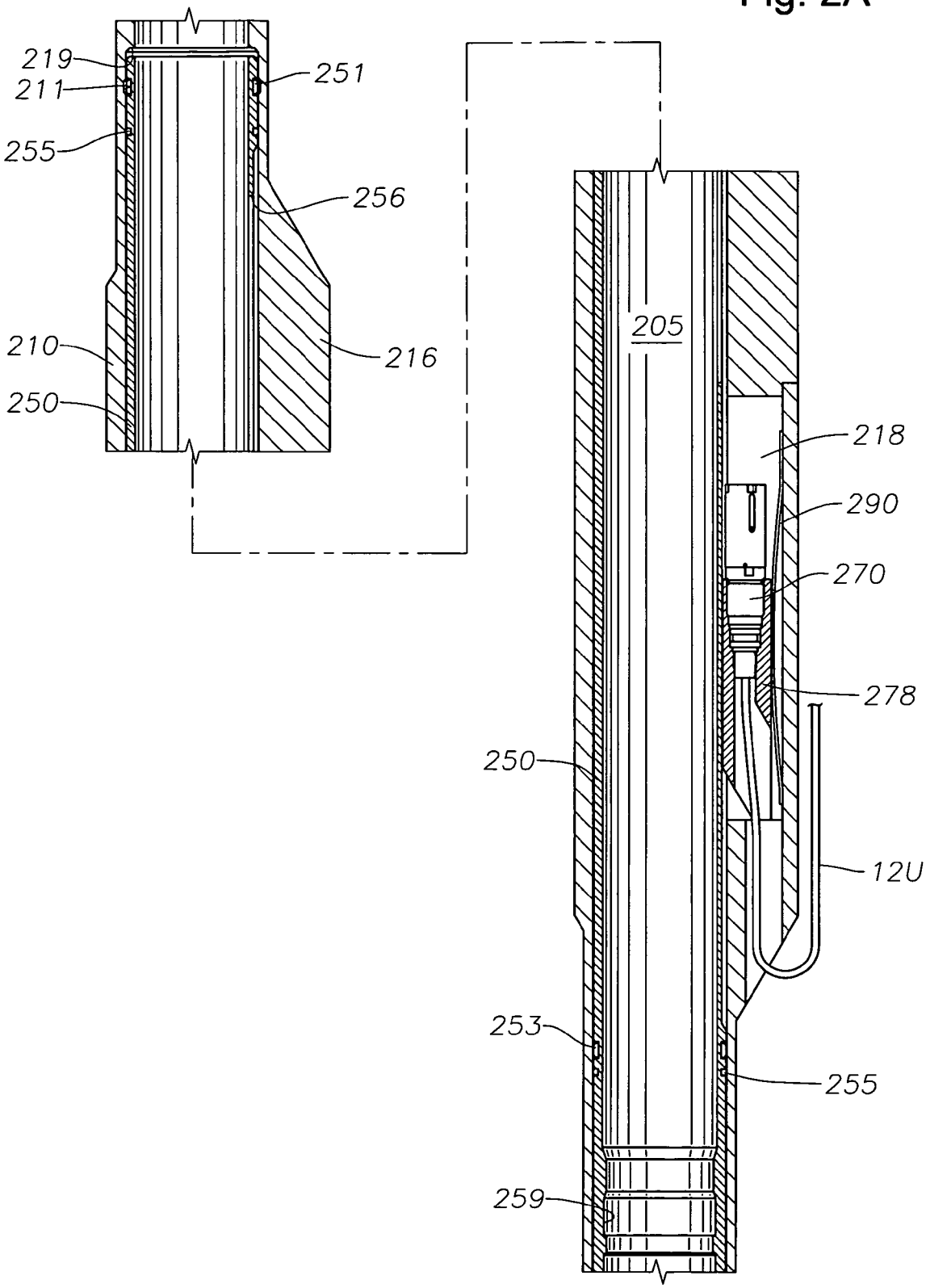
FIG. 2A is an enlarged partial sectional view of a portion of the landing tool of FIG. 2.

Referring to FIG. 2A, the enlarged outer diameter portion 216 of the offset mandrel 210 includes a debris sleeve 250 and a pocket 218 that houses a bow spring 290. The pocket 218 of the landing tool 200 houses an upper connector 270 within a connector guide 278 in the run-in position. The upper connector 270 connects to the lower end of the upper instrumentation line 12U. While only the lowest portion of the upper instrumentation line 12U is shown, it is understood that the line 12U runs to the surface. In the run-in position for the landing tool 200, the upper end of the debris sleeve 250 shoulders against a debris sleeve shoulder 219 along the inner diameter of the offset mandrel 210. However, the debris sleeve 250 is slideable along the inner diameter of the offset mandrel 210. The debris sleeve 250 includes a window 256 milled in a wall thereof. As the debris sleeve 250 is pushed downward during operation relative to the offset mandrel 210, the window 256 in the debris sleeve 250 moves adjacent the offset mandrel pocket 218. This serves to expose the connector 270 for the upper instrumentation line 12U to the inner bore 205 of the offset mandrel 210. This, in turn, allows the bow spring 290 to act against the connector guide 278 and urge the connector 270 through the window 256 of the debris sleeve 250 in order to align with the mating connector 370 of the stinger 300. For other embodiments, hydraulic force through coiled tubing, or other type of force, may also be used to urge the connector guide 278 inwardly toward the lower connector 370 of the stinger 300.

Figure 3:
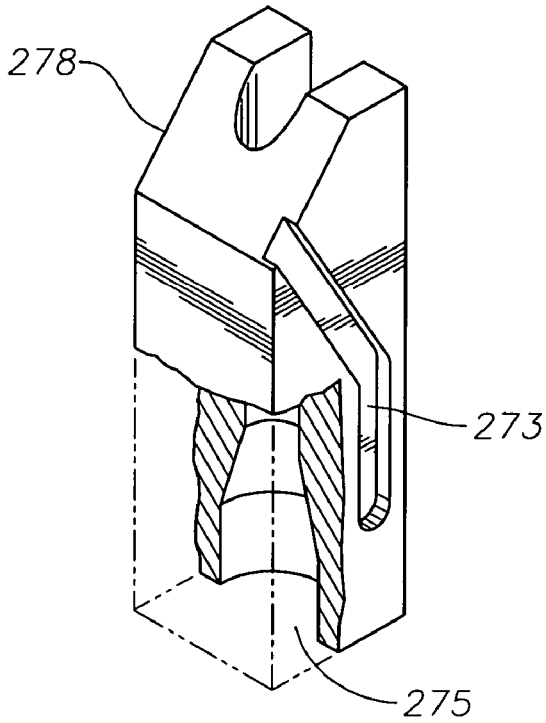
FIG. 3 is a perspective view in partial section of a connector guide of the landing tool that houses a connector for an upper instrumentation line.
Figure 9:
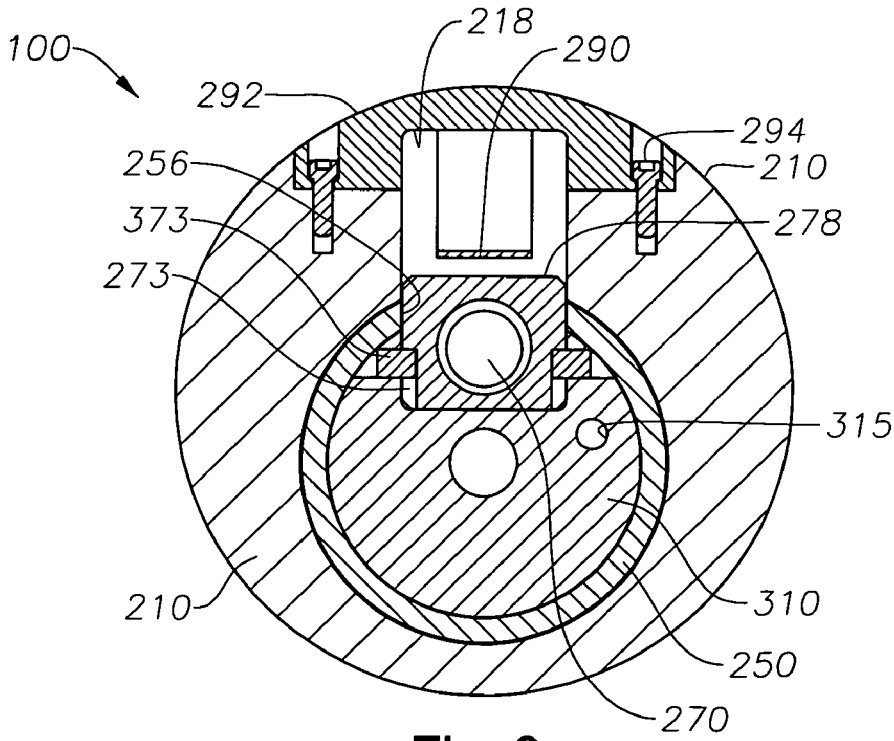
FIG. 9 is a cross section view of the coupler across line 9—9 in FIG. 8.

FIG. 3 shows a perspective view of the connector guide 278 apart from the offset mandrel 210. The connector guide 278 includes an opening 275 for receiving the lower end of the upper instrumentation line 12U (not shown) and at least a portion of the connector 270 (not shown). The connector guide 278 also includes a pair of pin grooves 273. As will be discussed in greater detail below, the opposing pin grooves 273 receive pins 373 within the debris sleeve 250 as shown in FIG. 9. As the bow spring 290 urges the connector guide 278 inwardly towards the bore 205 of the offset mandrel 210, the pins 373 mate with the pin grooves 273 to align the connector guide 278 and housed upper connector 270 with a lower connector 370 in the stinger 300.

Referring back to FIG. 2A, the debris sleeve 250 includes an upper snap ring 251, a lower snap ring 253 and an optional pair of debris wipers 255. In the run-in position shown in FIG. 2A, the upper snap ring 251 resides within a snap ring profile 211 along the offset mandrel 210 and the lower snap ring 253 resides closely around the debris sleeve 250. Both the upper and lower snap rings 251, 253 are biased outward. Therefore, the bias of the upper snap ring 251 maintains the upper snap ring 251 within the snap ring profile 211 until forced inwardly when sufficient force is applied against the top of the debris sleeve 250, thereby releasing the debris sleeve 250 from its axial location within the offset mandrel 210. This, in turn, permits the debris sleeve 250 to slide downwardly within the inner diameter of the offset mandrel 210. Thus, once the debris sleeve slides downward, the lower snap ring 253 expands into a lower snap ring profile 213 (shown in FIG. 2) along the offset mandrel 210. The debris wipers 255 essentially define elastomeric (or other pliable material) seals disposed circumferentially around the debris sleeve 250. The debris wipers 255 are placed at opposite ends of the window 256, and serve to keep debris from entering the window 256 and the pocket 218 of the offset mandrel 210.

Figure 5:
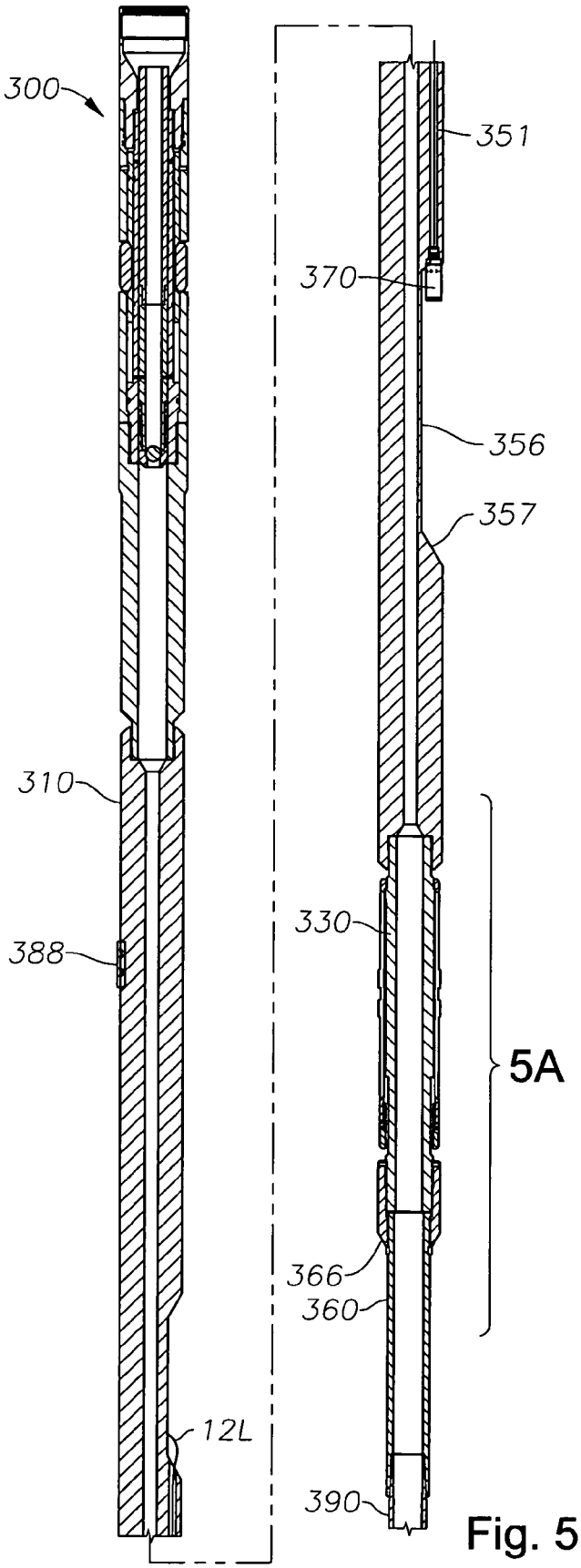
FIG. 5 is a partial sectional view of the stinger.

FIG. 5 illustrates a partial sectional view of a portion of the stinger 300 of the coupler 100 as shown in FIG. 1 and FIG. 8. As with the landing tool 200, the stinger 300 generally defines an elongated tubular body that includes a series of subs connected end-to-end. As shown, the stinger 300 includes subs such as a connector mandrel 310, a collet mandrel 330, a no-go sub 360, and at least one stinger sub 390 that connect to a lower end of one another successively by threads or otherwise. The connector mandrel 310 has an outer diameter dimensioned to be closely received within the inner diameter of both the orienting sleeve 280 and the debris sleeve 250 of the landing tool 200 as shown in FIG. 8. Disposed along the outer diameter of the connector mandrel 310 is the key 388. The key 388 represents a fixed protrusion that catches the orienting shoulder 286 of the orienting sleeve 280 when the stinger 300 is lowered into the landing tool 200. Also visible in FIG. 5 is the landing shoulder 366 for landing in the landing profile 236 of the landing tool 200 as described above. A no-go collar attached to the upper end of the no-go sub 360 serves as the shoulder 366 for the stinger 300.

The stinger subs 390 define an elongated tubular body that extends downward into the pay zone 55 of the wellbore 50 as shown in FIG. 1 or to any other depth where the sensors are desired. The lower instrumentation line 12L (shown in FIG. 1) attaches along the length of the stinger subs 390. The lower instrumentation line 12L may be clamped along the outer surface of the stinger subs 390, may dangle within a bore of the stinger 300 or dangle freely in the wellbore below the stinger subs 390.

The connector mandrel 310 includes a milled pocket 356 and a channel 351 extending from the pocket 356. The milled pocket 356 houses a lower connector 370 that is connected to the lower instrumentation line 12L. From the connector 370, the lower instrumentation line 12L travels through the channel 351. The lower instrumentation line 12L exits the channel 351 and turns back to run downward along the stinger 300. In one arrangement, the line 12L runs through a bore 315 (visible in the cross section views of FIG. 7 and FIG. 9) of the stinger 300. As illustrated in FIG. 8, the pocket 356 of the connector mandrel 310 also receives the connector guide 278 of the landing tool 200 when the coupler is in the connected position. The pocket 356 is deep enough to permit the upper connector 270 to completely clear the inner diameter of the offset mandrel 210. This, in turn, allows the upper connector 270 in the landing tool 200 to properly align in a radial direction with the lower connector 370 in the stinger 300 which is already aligned rotationally by the interaction of the key 388 with the orienting sleeve 280.

Figure 5A:
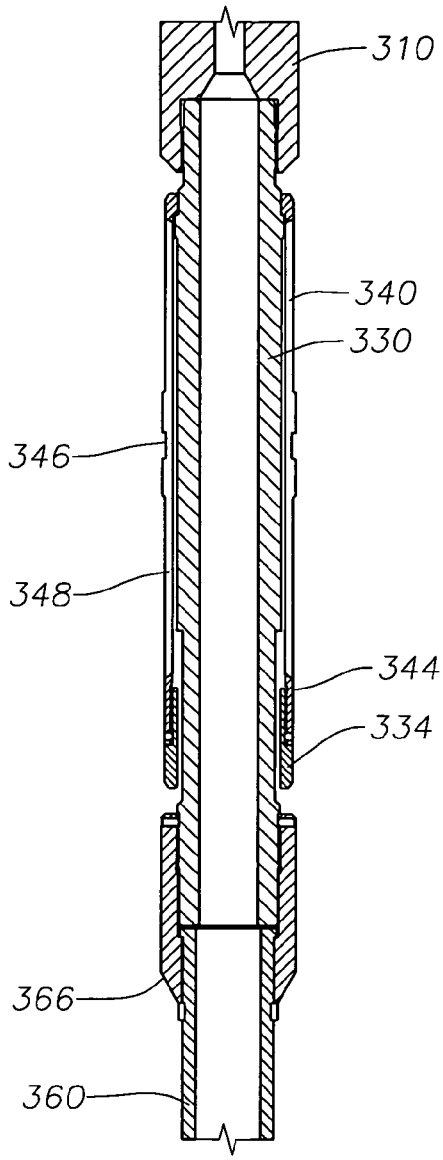
FIG. 5A is an enlarged sectional view of a portion of the stinger shown in FIG. 5.

Referring to FIG. 5A, a lower end of the collet mandrel 330 defines a collet stop 334. The collet stop 334 serves as a shoulder against which a collet 340 disposed around the collet mandrel 330 may be attached. The collet 340 has a base 344 connected to the collet stop 334 of the collet mandrel 330. In addition, the collet 340 has a plurality of outwardly biased fingers 348. The collet fingers 348 have an outer profile 346 that mates with a collet profile 259 (shown in FIG. 2 and FIG. 2A) along the inner diameter of the debris sleeve 250.

Figure 6:
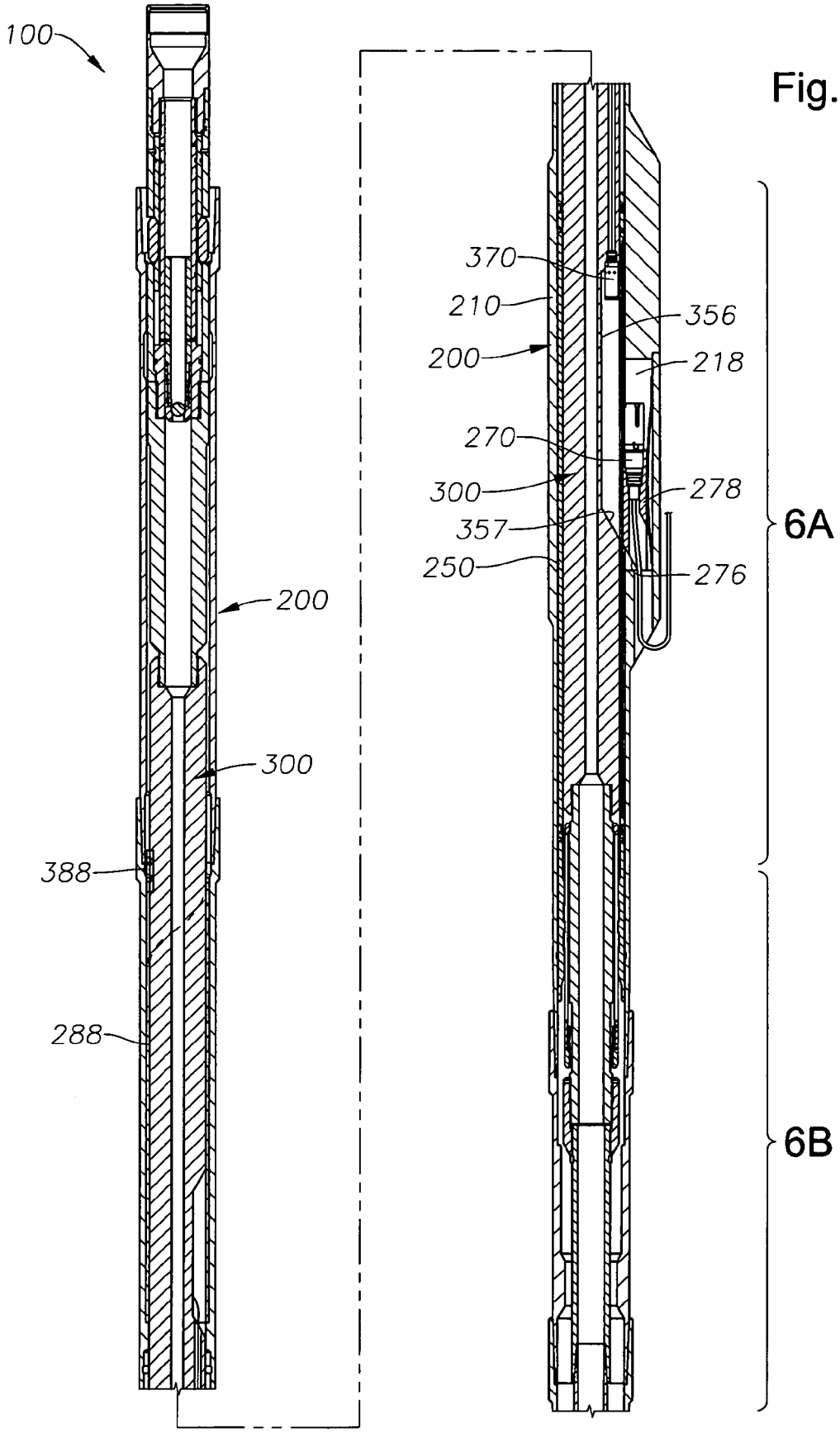
FIG. 6 is a partial sectional view of the coupler in an intermediate position with the stinger partially within the landing tool.

FIG. 6 illustrates an intermediate position of the coupler 100 as the stinger 300 traverses into the landing tool 200. Visible in the enlarged views of FIG. 6A and FIG. 6B, the outer profile 346 along the collet fingers 348 engage the collet profile 259 along the debris sleeve 250. Thus, axial movement of the stinger 300 transfers to the debris sleeve 250 in the landing tool 200 and shifts the debris sleeve 250 downward in order to expose the pocket 218 in the offset mandrel 210. As shown in the intermediate position, a small portion of the debris sleeve 250 adjacent the lower end of the window 256 continues to block outward movement of the connector guide 278 and housed upper connector 270 of the landing tool 200. Thus, the two connectors 370, 270 are not yet aligned since the connector guide 278 for the upper instrumentation line connector 270 has not yet moved inwardly and the key 388 has not yet seated in the bottom-out edge 288 of the orienting sleeve 280 in order to rotationally orient the lower connector of the stinger 300 when the coupler 100 is in the intermediate position as shown in FIG. 6.

Figure 6A:
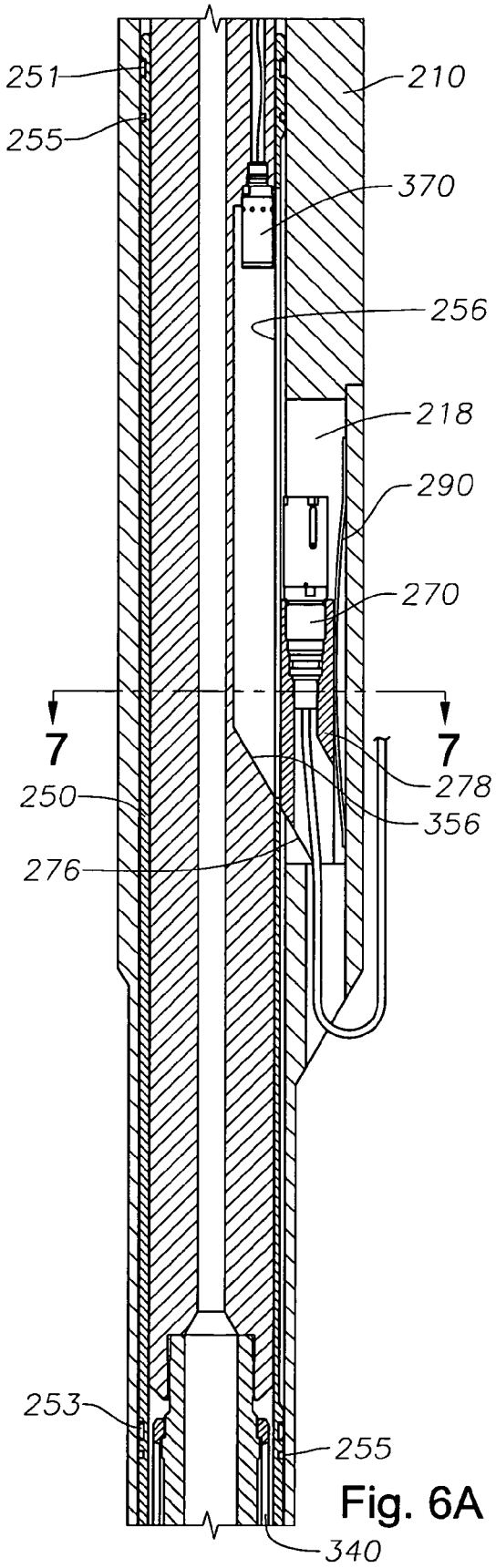
FIGS. 6A and 6B are enlarged partial sectional views of the coupler shown in FIG. 6 in the intermediate position.
Figure 6B:
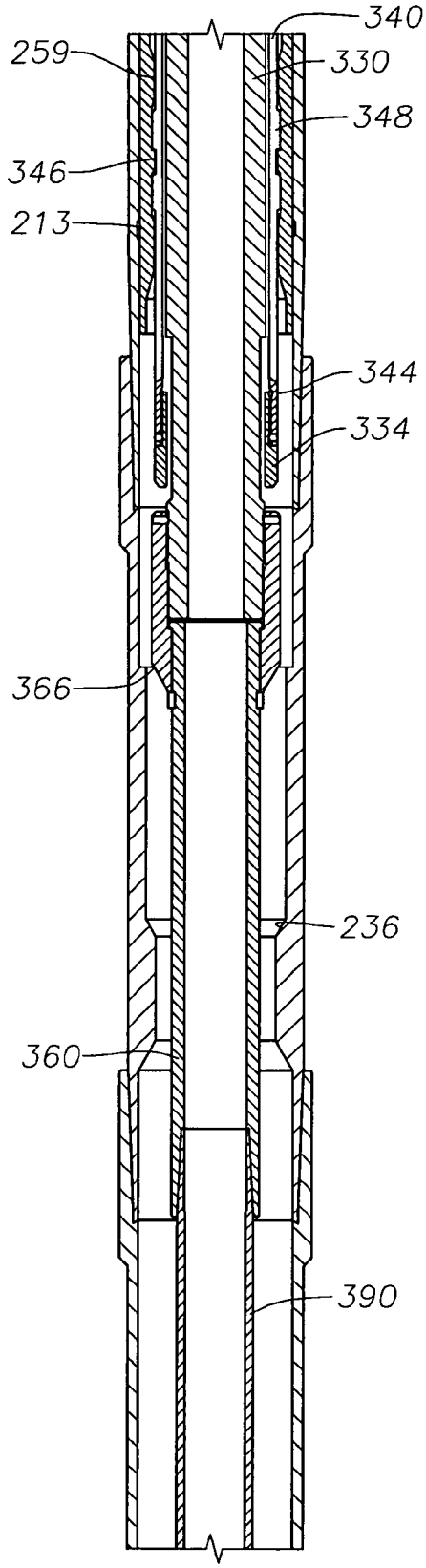
Figure 7:
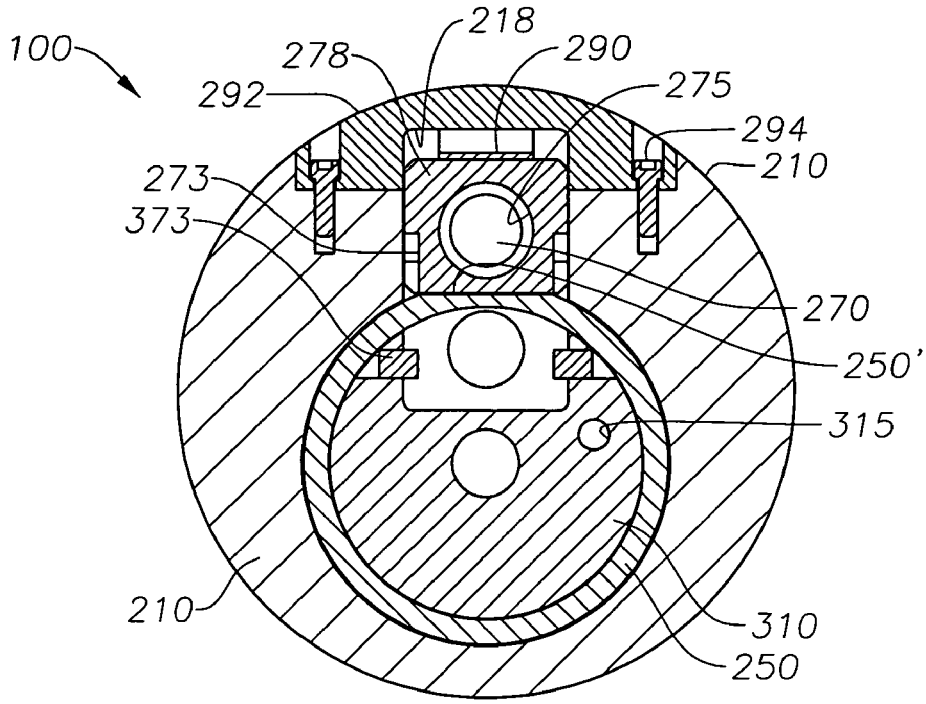
FIG. 7 is a cross section view of the coupler across line 7—7 in FIG. 6A.

FIG. 7 is a cross-sectional view of the coupler 200 taken across line 7—7 of FIG. 6A. As shown, the offset mandrel 210 includes a cap 292 on one side that serves as a spring housing. The cap 292 connects to the offset mandrel 210 by one or more fasteners 294. Also visible within the cross-sectional view of FIG. 7 is the connector guide 278 having the opening 275 for housing the connector 270. The pin grooves 273 are seen along the connector guide 278 for receiving the pins 373 within the debris sleeve 250. The bow spring 290 is in a compressed state, but is biased to urge the connector guide 278 inward. However, a flat surface 250' in the debris sleeve 250 butts against the connector guide 278 and prevents the connector guide 278 from moving inward towards the center of the coupler 100 since the coupler 100 is in the intermediate position.

FIG. 8 shows the coupler 100 in the connected position. In the connected position, the landing shoulder 366 of the stinger 300 contacts or lands on the profile 236 of the landing tool 200. As the stinger 300 moves between the intermediate position and the connected position, the bow spring 290 acts on the connector guide 278 that is no longer restrained by the debris sleeve 250 and urges the connector guide 278 inwardly towards the connector mandrel 310 of the stinger 300 such that the upper connector 270 aligns with the lower connector 370. Further, the key 388 of the stinger contacts the shoulder 286 and rotates the stinger 300 to position the key 388 within the bottom-out edge 288. This rotationally aligns the connectors 270, 370. As seen in the cross section view in FIG. 9, the pins 373 engage the grooves 273 along the connector housing 278, further aligning the upper connector 270.

Merely because the upper instrumentation line connector 270 has aligned with the lower instrumentation line connector 370 does not mean that communication has taken place as between the two connectors 270, 370. For example, where the two lines 12L, 12U are fiber optic lines, it is possible that oil residue or debris could come between the two connectors 270, 370, preventing optical communication. In this instance, it is desirable to pull the stinger 300 back up within the landing tool 200 before locking the stinger 300 in the landing tool 200 and circulate a cleaning fluid through a bore of the stinger 300. Thereafter, a reconnection can be attempted between the connectors 270, 370.

Once the coupler 100 is in the connected position and communication is established, the stinger 300 may be locked in the landing tool 200 with an optional latching mechanism 400 at the top of the stinger 300. The latching mechanism allows the position of the stinger 300 to be axially locked relative to the landing tool 200 and permits release of the stinger 300 from the landing tool 200 in the event it is desired to remove the stinger 300 from the wellbore 50. Any known releasable latching mechanism may be used between the stinger 300 and the landing tool 200 of the coupler 100. As shown, the latching mechanism 400 includes locking dogs 426 that are selectively moved outward into the profile 226 of the landing tool 200.

After the coupler 100 is in the connected position and when the stinger 300 is unlocked from the landing tool 200, the stinger 300 may be raised back up within the landing tool 200. In this manner, it is possible to return to the intermediate position shown in FIG. 6 or run-in position after placing the coupler 100 in the connected position shown in FIG. 8. Referring to FIG. 6, a beveled surface 357 is provided along the pocket 356 of the connector mandrel 310. The beveled surface 357 matches a beveled surface 276 of the connector guide 278. Thus, as the stinger 300 axially raises relative to the landing tool 200, the beveled surface 357 of the connector mandrel 310 engages the beveled surface 276 of the connector guide 278 and urges it back outwardly towards the pocket 218 in the offset mandrel 210. The outward force of the connector mandrel 310 on the connector guide 278 overcomes the inward force of the bow spring 290. In this manner, the stinger 300 can be raised for circulation of cleaning fluid when attempting to establish communication or completely removed from the wellbore during well completion and remediation procedures that may damage the lower instrumentation line 12L.

While the foregoing is directed to embodiments of the present invention, other and further embodiments of the invention may be devised without departing from the basic scope thereof, and the scope thereof is determined by the claims that follow.

The invention claimed is:

1. A method for installing an instrumentation line in a wellbore, comprising:

locating a landing tool within the wellbore, the landing tool having a connector for an upper instrumentation line coupled thereto; and landing a stinger onto the landing tool, wherein landing the stinger axially displaces a blocking member that retains the connector for the upper instrumentation line out of alignment with a connector for a lower instrumentation line and aligns and places the connector for the upper instrumentation line in communication with the connector for the lower instrumentation line, the connector for the lower instrumentation line coupled to the stinger.

2. The method of claim 1, wherein landing the stinger positions a key of the stinger along an orienting shoulder of the landing tool to orient the stinger relative to the landing tool.

3. The method of claim 1, wherein blocking member retains the connector for the upper instrumentation line within a pocket of the landing tool.

4. The method of claim 3, further comprising biasing the connector for the upper instrumentation line out of the pocket and into alignment with the connector for the lower instrumentation line.

5. The method of claim 4, wherein biasing the connector is provided by a spring.

6. The method of claim 1, further comprising locking the stinger in the landing tool.

7. A method for installing an instrumentation line into a wellbore, comprising:

attaching a landing tool to a tubular string, the landing tool having a landing profile thereon;

affixing an upper instrumentation line along the length of the tubular string, the upper instrumentation line having a first end that terminates at the landing tool;

running the tubular string and attached landing tool into the wellbore;

affixing a lower instrumentation line along the length of a stinger, the lower instrumentation line having a first end that terminates at the stinger;

running the stinger into the wellbore on a working string, the stinger having a shoulder for landing on the landing profile of the landing tool;

landing the stinger onto the landing tool;

axially displacing a blocking member with the stinger, wherein the blocking member prevents alignment of the first ends of the upper and lower instrumentation lines to align the first end of the upper instrumentation line with the first end of the lower instrumentation line; and placing the first end of the upper instrumentation line in communication with the first end of the lower instrumentation line.

8. The method of claim 7, wherein the upper instrumentation line and the lower instrumentation line each define an electrical line.

9. The method of claim 7, wherein the upper instrumentation line and the lower instrumentation line each define a fiber optic cable.

10. The method of claim 7, wherein the landing profile in the landing tool is disposed along an inner diameter of the landing tool.

11. The method of claim 7, wherein the lower instrumentation line is placed within an inner bore of a sand screen when the stinger is landed on the landing tool.

12. The method of claim 7, further comprising:

releasing the working string from the stinger; and removing the working string from the wellbore.

13. The method of claim 12, further comprising:

running a working string back into the wellbore;

latching an end of the working string to the stinger; and removing the working string and stinger from the wellbore.

14. The method of claim 7, wherein the tubular string is a string of production tubing and the production tubing has a production packer above the landing tool.

15. The method of claim 7, further comprising setting a production packer before landing the stinger on the landing tool.

16. A coupler for connecting an upper instrumentation line with a lower instrumentation line within a wellbore, comprising:

a landing tool located in the wellbore and having a connector for the upper instrumentation line coupled thereto and a blocking member that prevents connection of the upper instrumentation line; and a stinger having a body portion and a connector for the lower instrumentation line coupled thereto, wherein the connectors mate by running at least a portion of the body of the stinger into the landing tool and displacing the blocking member.

17. The coupler of claim 16, wherein the landing tool comprises an orienting shoulder that engages a key of the stinger to rotationally align the stinger with respect to the landing tool.

18. The coupler of claim 16, wherein the stinger extends to a predetermined depth in the wellbore and the lower instrumentation line is coupled along the stinger to the predetermined depth.

19. The coupler of claim 16, wherein the connector for the upper instrumentation line is initially disposed within a pocket of the landing tool in a run-in position.

20. The coupler of claim 19, wherein the connector for the upper instrumentation line is moved out of the pocket and into alignment with the connector for the lower instrumentation line.

21. The coupler of claim 20, wherein the connector for the upper instrumentation line is moved out of the pocket by a spring.

22. The coupler of claim 16, wherein the stinger comprises a locking mechanism that locks the stinger within the landing tool.

23. The coupler of claim 16, wherein the blocking member comprises a slidable debris sleeve with a window that exposes the connector for the upper instrumentation line to the connector for the lower instrumentation line.

24. A coupler for connecting an upper instrumentation line with a lower instrumentation line within a wellbore, the upper instrumentation line being placed along a tubular string within the wellbore, the coupler comprising:

a stinger, comprising:

a tubular body;

a shoulder along the tubular body; and a second connector connected to a first end of a lower instrumentation line; and a landing tool, the landing tool comprising:

a tubular body;

a landing profile along the tubular body of the landing tool, the landing profile being dimensioned to receive the shoulder of the stinger; and a first connector connected to a first end of the upper instrumentation line and confined by a blocking member configured to prevent alignment of the first connector with the second connector, the first connector of the landing tool placing the upper instrumentation line in communication with the lower instrumentation line when the stinger is landed on the landing tool and the blocking member is displaced.

25. The coupler of claim 24, wherein the upper instrumentation line and the lower instrumentation line each define an electrical line.

26. The coupler of claim 24, wherein the upper instrumentation line and the lower instrumentation line each define a fiber optic cable.

27. The coupler of claim 24, wherein the landing profile in the landing tool is disposed along an inner diameter of the landing tool.

28. The coupler of claim 24, wherein the stinger is releasably contemptible to a working string.

29. The coupler of claim 24, further comprising a latching mechanism that releasably connects the stinger to the landing tool.

* * * * *

UNITED STATES PATENT AND TRADEMARK OFFICE

CERTIFICATE OF CORRECTION

PATENT NO. : 7,213,657 B2
APPLICATION NO. : 10/812273
DATED : May 8, 2007
INVENTOR(S) : Vold et al.

It is certified that error appears in the above-identified patent and that said Letters Patent is hereby corrected as shown below:

In the Claims:

In Column 12, Claim 28, Line 9, please delete "contemptible" and insert --connectible--.

Signed and Sealed this

Thirty-first Day of July, 2007

JON W. DUDAS
*Director of the United States Patent and Trademark Office*